US006653790B2

(12) United States Patent
Willamor et al.

(10) Patent No.: US 6,653,790 B2
(45) Date of Patent: Nov. 25, 2003

(54) AUTOMATIC GAS LAMP WITH SAFETY CONTROL CIRCUIT

(76) Inventors: Marty Willamor, 6450 Lake Victoria Dr., Theodore, AL (US) 36582-5048; Joseph E. Jefferson, Jr., 907 Delchamps Ave., Dauphin Island, AL (US) 36528

( * ) Notice: Subject to any disclaimer, the term of this patent is extended or adjusted under 35 U.S.C. 154(b) by 0 days.

(21) Appl. No.: 10/100,199

(22) Filed: Mar. 19, 2002

(65) Prior Publication Data

US 2003/0178944 A1 Sep. 25, 2003

(51) Int. Cl.[7] ..... H05B 39/10; F23N 5/00
(52) U.S. Cl. ..... 315/91; 431/69; 431/18
(58) Field of Search ..... 315/91; 431/18, 431/69, 70, 71, 66, 67, 86, 87; 423/345–346; H05B 39/10; F23N 5/00

(56) References Cited

U.S. PATENT DOCUMENTS 2,138,301 A * 11/1938 Howie ..... 446/57
3,723,045 A * 3/1973 Reese ..... 431/18
3,862,820 A * 1/1975 Hantack ..... 431/66
4,056,348 A * 11/1977 Wolfe ..... 431/66
4,088,105 A * 5/1978 Bhat et al. ..... 123/145 A
4,128,387 A * 12/1978 Rayburn et al. ..... 431/78
4,487,030 A * 12/1984 Carter et al. ..... 62/141
4,917,866 A * 4/1990 Abe et al. ..... 423/345
5,478,232 A * 12/1995 Dillinger et al. ..... 431/255
5,503,549 A * 4/1996 Iasella ..... 431/18
5,636,978 A * 6/1997 Sasaki ..... 431/69
5,980,238 A * 11/1999 Collins, Sr. ..... 431/18

* cited by examiner

*Primary Examiner*—Don Wong
*Assistant Examiner*—Trinh Vo Dinh
(74) *Attorney, Agent, or Firm*—George A. Bode; Lisa D. Velez; Bode & Associates

(57) ABSTRACT

A gas lamp system and method for lighting the system which utilizes a sparkless flame starter in close proximity to the torch to create a flame. The system further includes a safety control circuit which activates the sparkless flame starter and subsequently actives a gas valve to deliver the gas to the torch after the sparkless flame starter has been energized. The sparkless flame starter is a low-voltage device such as a glow coil which is also arcless.

16 Claims, 3 Drawing Sheets

AUTOMATIC GAS LAMP WITH SAFETY CONTROL CIRCUIT

BACKGROUND OF THE INVENTION

1. Field of the Invention

The present invention relates to a gas lamp system, and, more particularly, to an automatic gas lamp system which is utilizes a sparkless flame started such as a glow coil and a safety control circuit that is AC powered.

2. General Background

External gas-powered lamps are designed to be automatically lit at the beginning of night, burn through the night and subsequently automatically extinguished at daybreak. Typically, the external gas-powered lamps are lit by means of opening a gas valve to allow the gas to flow to the burner or torch and creating a spark in close proximity to the burner or torch to start a flame. The sparks are created by high voltage producing devices, which consume relatively large amounts of electrical energy and can be hazardous.

Several systems have been patented which are aimed at gas lighting systems.

U.S. Pat. No. 3,723,045, issued to Reese, entitled "LIGHTING SYSTEM" discloses a gas lighting system having a gas lamp equipped with a burner connected to a source of gas. The system includes a selectively operable igniter energized by an electrical circuit, which has a photo cell and a timer for controlling a solenoid valve. The system, when in an active mode, is designed to detect when a flame is extinguished to attempt to re-light the flame.

U.S. Pat. No. 5,636,978, issued to Elco Company, Ltd., of Japan, on the application of Sasaki, entitled "COMBUSTION APPARATUS," discloses a gas lighting system, having a gaslight equipped with a burner connected to a source of gas. A selectively operable igniter is energized by an electrical circuit having a flame detection circuit and a timer circuit for controlling a solenoid valve. The flame detection circuit detects when the flame has gone out half-way.

U.S. Pat. No. 5,478,232, issued to Trimble House Corporation, of Norcross, Georgia, on application to B. R. Dillinger, entitled "AMBIENT LIGHT CONTROLLED OUTDOOR GAS LIGHT" discloses an outdoor lamp which includes a photocell array, which causes an electrical circuit to open a valve at dawn and to close a valve at night. A sensor is provided to detect when the lamp is lighted to discontinue the spark.

U.S. pat. No. 5,503,549, issued to Iasella, entitled "ULTRA LOW POWER VALVE FOR THE CONTROL OF GAS FLOW", disclose a gas lamp having a "popper" valve in a gas line. The valve is controlled by an electromagnet activated by a photo-voltaic solar cells, which control the flow of gas to the burner.

Other patents in the art include U.S. Pat. No. 5,980,238, issued to J. C. Collins, Sr., entitled "GAS LIGHT ASSEMBLY"; U.S. Pat. No. 5,468,142, issued to Modern Home Products Corp., of Antoich, ill, on application to W. Koziol, entitled "GAS LIGHT CONTROL APPARATUS"; U.S. Pat. Nos. 3,188,836 and 3,330,133, issued to D. V. Knieves, entitled "GAS CONTROL MECHANISM" all of which describe various gas-powered lamps and means for turning on and off such lamps.

SUMMARY OF THE PRESENT INVENTION

The preferred embodiment of automatic gas lamp system of the present invention solves the aforementioned problems in a straight forward and simple manner.

Broadly, the present invention contemplates an AC powered gas lamp system which utilizes a sparkless flame starter in close proximity to the torch to create a flame. The system further includes a safety control circuit which activates the sparkless flame starter and subsequently activates a gas valve to deliver the gas to the torch.

The present invention further contemplates a sparkless and arcless flame starter, such as a glow coil.

Additionally, the present invention contemplates a method of lighting a gas lamp system comprising the steps of: (a) determining night; (b) when the night is determined, turning "on" the gas lamp system and activating a sparkless flame starter; and, (c) after step (b), opening a gas valve to light a torch after a pre-set delay.

The above and other objects and features of the present invention will become apparent from the drawings, the description given herein, and the appended claims.

BRIEF DESCRIPTION OF THE DRAWING

For a further understanding of the nature and objects of the present invention, reference should be had to the following description taken in conjunction with the accompanying drawings in which like parts are given like reference numerals and, wherein.

DETAILED DESCRIPTION OF THE PREFERRED EMBODIMENT

Figure 1:
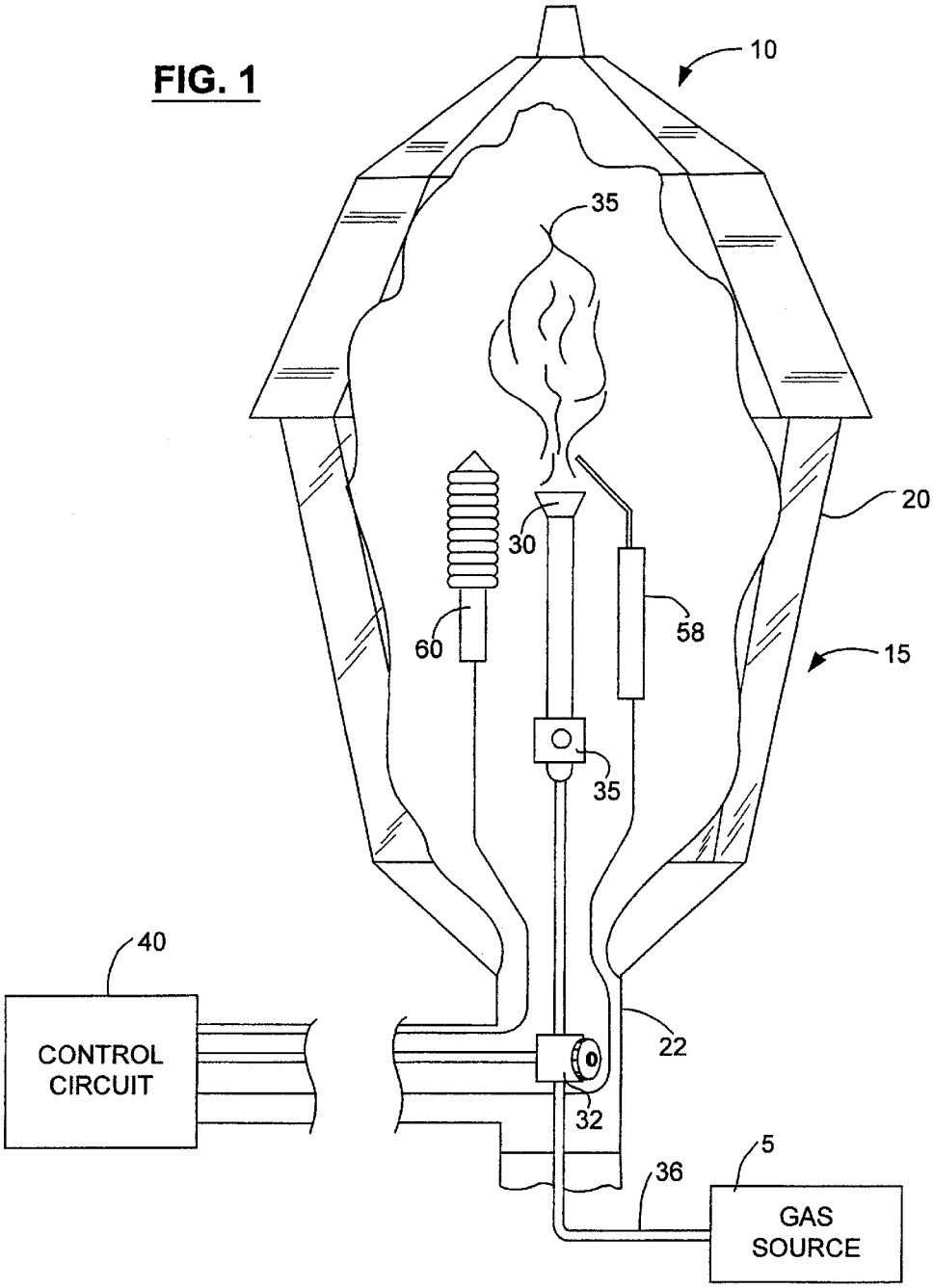
FIG. 1 illustrates the automatic gas lamp system of the present invention.
Figure 2:
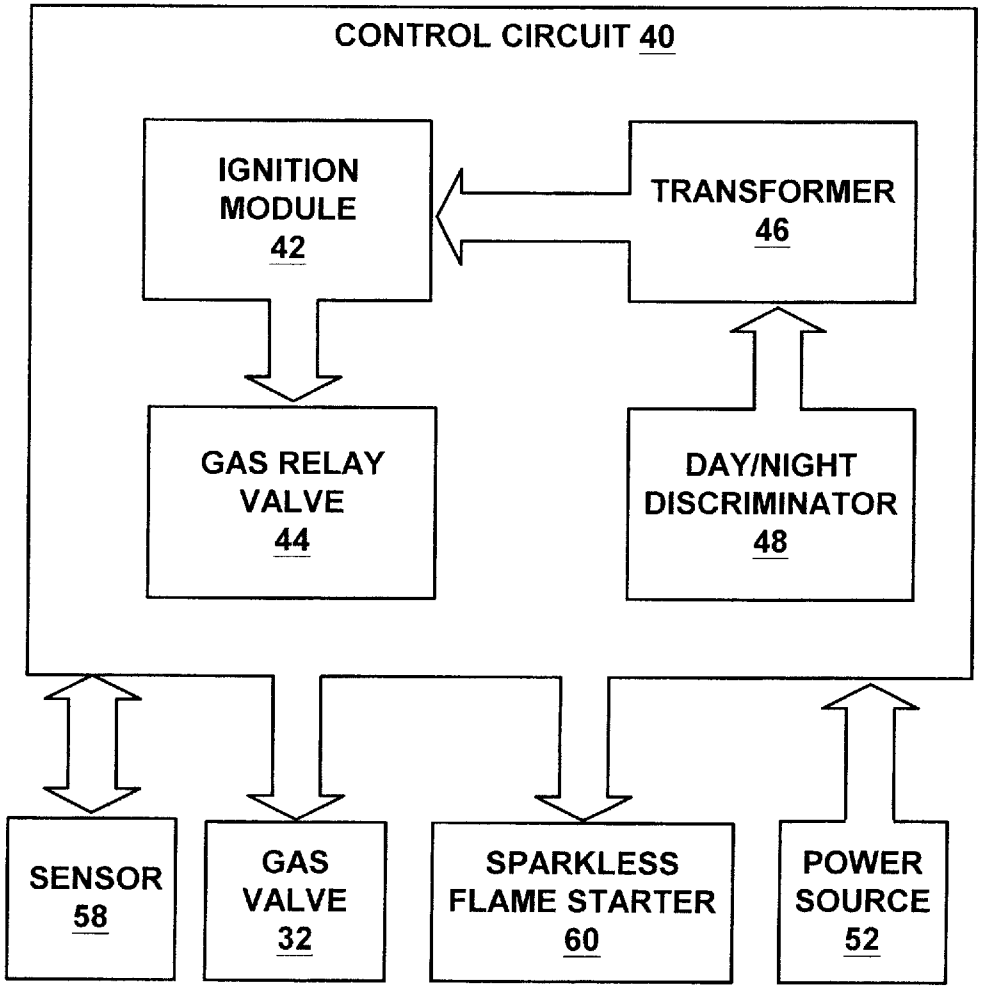
FIG. 2 illustrates the general block diagram of the control circuit of the present invention; and, FIG. 3 illustrates a general schematic diagram of the gas lamp system of the present invention.
Figure 3:
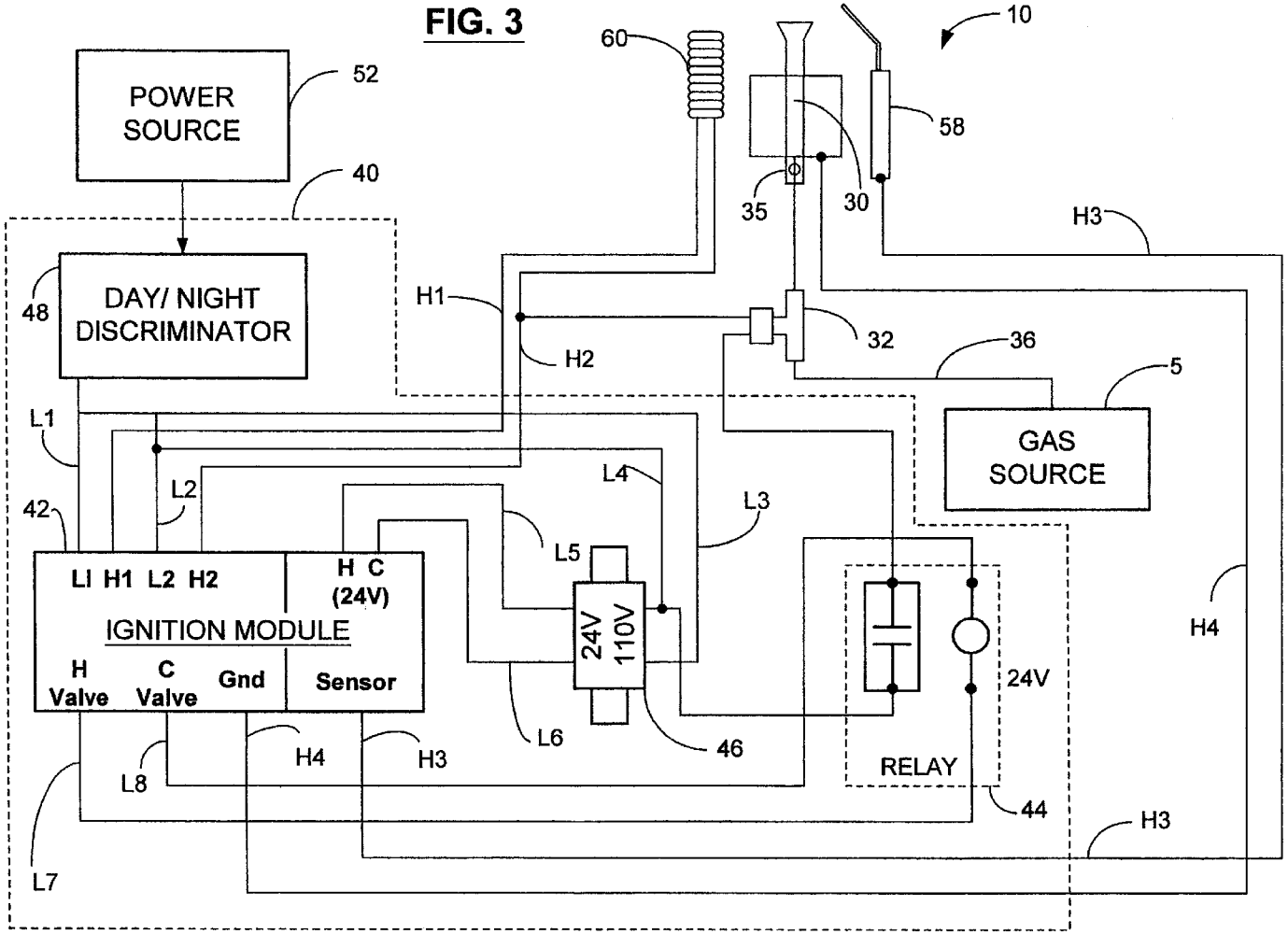

Referring now to the drawings and in particular FIGS. 1 and 2, the automatic gas lamp system of the present invention is generally referenced by the numeral 10. The gas lamp system 10 of the present invention is generally comprised of a gas lamp 15 and a safety control circuit 40 controlling a low-voltage flame starter or glow coil 60. The low-voltage flame starter or glow coil 60 are sparkless flame starting means used to create the flame 35. Furthermore, the flame starting means does not create an arc. The gas lamp system 10 further includes a flame sensor 58.

The gas lamp 15 includes a lamp housing 20 and lamp post 22 which supports the lamp housing 20 at the top thereof. However, the lamp housing 20 may be mounted to an external wall of a building or dwelling. The lamp housing 20 houses a torch 30 fed by gas source 5 via gas line 36. The gas line 36 is coupled to gas valve 32 which in turn is coupled to gas cock 35. In the exemplary embodiment, the gas valve 32 and the gas cock 35 are housed in the lamp post 22. Moreover, the gas valve 32 is a 24 Volt AC operated gas valve.

Referring now to FIGS. 2 and .3, the control circuit 40 functions in a plurality of operating modes. The operating modes include an automatic turn-on cycle, an automatic startup re-lighting cycle, an automatic lighting failure shutdown cycle, an automatic re-lighting cycle and an automatic turn-off cycle to minimize hazards associated with gas powered lamps, as will be described in more detail below.

The general block diagram and schematic diagram of the control circuit 40 includes an ignition module 42, gas valve relay or solenoid 44, a transformer 46 and a timer or day/night discriminator 48. The timer or day/night discriminator 48 is powered by power source 52 and determines whether it is day or night. In the preferred embodiment the power source 52 is AC power. When the timer or day/night discriminator 48 determines that it is night, the system 10 is activated to an "active" or "on" state.

When it is night, power is delivered on lines L1 and L2 to power transformer 46 via lines L3 and L4 and the ignition module 42. Furthermore, power (110 Volts) from line L1 is sent to gas valve relay or solenoid 44 via line L4.

The transformer 46 transforms the 110 Volts to 24Volts which is sent to the ignition module 42 on lines LS and L6. The ignition module 42 is programmed to activate the gas valve relay or solenoid 44 after a selected or pre-set delay via lines L7 and L8. In other words, when the gas valve relay or solenoid 44 is activated by the ignition module 42, the 110 Volts from line L4 is sent to the gas valve 32.

Furthermore, when the night is determined, the control circuit 40, the ignition module 42 is programmed to power the low-voltage flame starter or the glow coil 60 positioned over or in close proximity to torch 30 via lines H1 and H2. Once the flame 35 is started, the ignition module 42 is programmed to deactivate the low-voltage flame starter or the glow coil 60. The ignition module 42 receives a detection signal on line H3 from the flame sensor 58 positioned near torch 30. The sensor path is complete, then the flame sensor 58 is powered from ignition module 42.

In the exemplary embodiment, the ignition module 42 provides ground on line H4 which is coupled to the lamp housing 20.

Referring now to the operation of the control circuit 40, the automatic turn-on cycle will now be described in detail. The gas cock 40 is manually set in an "open" position. When the timer or day/night discriminator 48 determines when dusk (night) and dawn (day) are nearing to turn on and off the control circuit 40 and thus, system 10. The control circuit 40 is turned on during the night mode and off during a day mode. For example, the day/night discriminator may be an ambient light detector to turn on and off the control circuit 40 as the ambient light changes.

When the control circuit 40 is turned on power is delivered to the transformer 46 which in turn activates the ignition module 42. After a first pre-set delay (such as, 30 seconds, in the preferred embodiment, the ignition module 42 activates the low-voltage flame starter or glow coil 60 so that it begins to glow. Furthermore, after a second pre-set delay, the ignition module 42 activates the gas valve relay or solenoid 44 to open gas valve 32. Thereby, the low-voltage flame starter or glow coil 60 has a sufficient amount of time to heat up before the gas is supplied to the torch 30. Hence, metering of gas prior to staring the low-voltage flame starter or glow coil 60 is eliminated.

In the preferred embodiment, the flame sensor 58 is continuously powered when the system 10 is "active" or "on" and serves to sense the heat of flame 35 from torch 30. The detection signal from the flame sensor 58 is sent to the ignition module 42 or control circuit 40 on line H3. If the detection signal identifies the presence of the flame 35, the ignition module 42 deactivates (turns off) the low-voltage flame starter or glow coil 60. The gas valve 32 remains "open."

However, if the automatic turn-on cycle is unsuccessful the automatic start-up re-lighting cycle will commence. The automatic start-up re-lighting cycle is initiated if a flame 35 at torch 30 is not sensed by the flame sensor 58 within 6 seconds or other pre-set time. After the 6 seconds or other pre-set time, if the detection signal identifies the absence of a flame 35, the ignition module 42 deactivates the gas valve relay or solenoid 44 to close gas valve 32 and the low-voltage flame starter or glow coil 60. The control circuit 40 reinitializes after a third pre-set delay, such as 90 seconds. At such time, the ignition module 42 is re-activated to activate the low-voltage flame starter or glow coil 60 so that it begins to glow. Furthermore, after the second pre-set delay, the ignition module 42 activates the gas valve relay or solenoid 44 to open gas valve 32. Again, the detection signal from the flame sensor 58 is sent to the ignition module 42 or control circuit 40. If the detection signal identifies the presence of the flame 35, the ignition module 42 deactivates (turns off) the low-voltage flame starter or glow coil 60. The gas valve 32 remains "open."

However, if during the automatic start-up re-lighting cycle the flame 35 remains extinguished, the control circuit 40 may repeat the automatic startup re-lighting cycle again. As can be appreciated, repeating the automatic start-up re-lighting cycle is optional and may be repeated several times.

However, if the detection signal identifies the absence of the flame 35 again, the control circuit 40 transitions to the automatic lighting failure shut-down cycle where the ignition module 42 is "locked out" as a safety measure, which in turn shuts down the gas lamp system 10. When the ignition module 42 is "locked out," the low-voltage flame starter or glow coil 60 remains de-energized and the gas valve 32 remains "closed."

When the gas lamp system 10 is shut down, the gas torch 30 of the gas lamp 10 will not emit gas without a flame 35 and therefore, minimizes metering of gas when the system 10 has failed.

After the time has expired or day is detects by the timer or day/night discriminator 48, the control circuit 40 transitions into an automatic turned-off cycle whereby the system 10 is turned-off or shut-down until the next night.

In summary, the automatic turn-on cycle includes the following steps: (1) power is applied to ignition module 42 by timer or day/night discriminator 48; (2) after a 30 second delay, low-voltage flame starter or glow coil 60 is energized; (3) After a 15 second delay, the gas valve 32 is opened; and, (4) if the torch 30 is lit and the flame 35 is sensed by flame sensor 58, the low-voltage flame starter or glow-coil 60 is de-energized.

In summary, the automatic startup re-lighting cycle includes the following steps: (5) if the flame 35 is not detected or sensed within 6 seconds or other pre-set delay, the gas valve 32 is shut-off or de-energized, stopping the flow of gas to the torch 30; and, (6) after 90 seconds, the ignition module 44 will try to re-light the flame 35 by recycling through steps 2–5 or 2–6.

In the exemplary embodiment, the automatic startup re-lighting cycle can be repeated twice. However, if the automatic startup re-lighting cycle is unsuccessful, the system 10 will be "locked out" until the next "on" cycle.

Furthermore, in the exemplary embodiment, flame sensor 58 continuously monitors for the presence or absence of the flame 35. Thereby, if the flame 35 is extinguished during the "on" cycle, such as the result of wind, the automatic re-lighting cycle commences. During the automatic re-lighting cycle, after 90 seconds or other pre-set delay, the ignition module 44 will try to re-light the flame 35 by recycling through steps 2–5 or 2–6. As can be appreciated, the automatic startup re-lighting cycle and the automatic re-lighting cycle differ in that during automatic startup re-lighting cycle the ignition module 44 is not re-initialized immediately since the low-voltage flame starter or glow coil 60 is on or activated.

Because many varying and differing embodiments may be made within the scope of the inventive concept herein taught and because many modifications may be made in the embodiment herein detailed in accordance with the descriptive requirement of the law, it is to be understood that the details herein are to be interpreted as illustrative and not in a limiting sense.

What is claimed as invention is:

1. A gas lamp system comprising:

a gas powered lamp having a torch and a gas valve;

a sparkless flame starter in close proximity to the torch to create a flame;

a safety control circuit for activating said flame starter and subsequently activating the gas valve to start the flame, said safety control circuit including a plurality of operating modes which include an automatic turn-on cycle, an automatic startup re-lighting cycle, an automatic lighting failure shut-down cycle, an automatic re-lighting cycle and an automatic turn-off cycle; and, a flame sensor in close proximity to the torch which senses a presence or absence of said flame.

2. The system of claim 1, wherein the control circuit comprises:

a day/night discriminator which determines night and day;

an ignition module activated during the night to activate said sparkless flame starter; and, a gas valve relay which opens the gas valve to deliver said gas to said torch.

3. The system of claim 2, wherein said day/night discriminator is a timer or an ambient light detector.

4. The system of claim 2, wherein when said day/night discriminator detects the night, the control circuit transitions to the automatic turn-on cycle where said ignition module activates said sparkless flame starter after a first pre-set delay of said day/night discriminator, activates said gas valve relay to open said gas valve after a second pre-set delay of said day/night discriminator; and, said flame sensor senses heat to detect the presence of the flame from said torch; and, if the flame is not sensed by said flame sensor within a predetermined time said control circuit transitions to the automatic startup re-lighting cycle to attempt to relight the torch; and, if during the automatic startup re-lighting cycle the flame remains extinguished, the control circuit transitions to the automatic lighting failure shut-down cycle where said ignition module is "locked out" as a safety measure.

5. The system of claim 1, wherein:

said automatic startup re-lighting cycle commences when said flame sensor detects the absence of said flame during said automatic turn-on cycle;

said automatic lighting failure shut-down cycle commences after at least one cycle of said automatic startup re-lighting cycle;

said automatic re-lighting cycle commences when said flame goes out after the automatic turn-on cycle; and, an automatic turn-off cycle commences when day is detected.

6. The system of claim 1, wherein said sparkless flame starter is a glow coil.

7. A gas lamp system comprising:

means for burning gas in a form of a flame;

means coupled to the gas burning means for selectively delivering gas;

means for starting a flame by said gas burning means which is sparkless and low-voltage producing;

means for controlling and activating said flame starting means and subsequently activating said gas delivering means to start the flame during night, said controlling and activating means includes a plurality of operating modes which include an automatic turn-on cycle, an automatic startup re-lighting cycle, an automatic lighting failure shut-down cycle, an automatic re-lighting cycle and an automatic turn-off cycle; and, means for sensing a flame in close proximity to said gas burning means which senses a presence or absence of said flame.

8. The system of claim 7, wherein said controlling and activating means comprises:

means for determining night and day;

means for igniting said flame which is activated during the night to activate said flame starting means; and, a solenoid which opens the gas delivering means to deliver said gas to said gas burning means.

9. The system of claim 8, wherein said night and day determining means is a timer or an ambient light detector.

10. The system of claim 8, wherein when said night and day determining means detects the night, the controlling and activating means transitions to the automatic turn-on cycle where said igniting means activates said flame starting means after a first pre-set delay of said day/night discriminator, activates said solenoid to open said gas delivering means after a second pre-set delay of said day/night discriminator; and, said flame sensing means senses heat to detect the presence of the flame from said gas burning means; and, if the flame is not sensed by said flame sensing means within a predetermined time said controlling and activating means transitions to the automatic startup re-lighting cycle to attempt to relight said gas burning means; and, if during the automatic startup re-lighting cycle the flame remains extinguished, the controlling and activating means transitions to the automatic lighting failure shut-down cycle where said igniting means is "locked out" as a safety measure.

11. The system of claim 7, wherein:

said automatic startup re-lighting cycle commences when said flame sensing means detects the absence of said flame during said automatic turn-on cycle;

said automatic lighting failure shut-down cycle commences after at least one cycle of said automatic startup re-lighting cycle;

said automatic re-lighting cycle commences when said flame goes out after the automatic turn-on cycle; and, an automatic turn-off cycle commences when day is detected.

12. The system of claim 7, wherein said flame starting means is a glow coil.

13. A method of lighting a gas lamp system comprising the steps of:

(a) determining night;

(b) when the night is determined, turning "on" the gas lamp system and activating a sparkless flame starter; and, (c) after step (b), opening a gas valve to light a torch after a pre-set delay of said day/night discriminator.

14. The method of claim 13, further comprising the step of:

(d) sensing if the flame present by a flame sensor;

(e) if the flame is present maintain said gas valve open; and, (f) if the presence of the flame is not sensed, performing an automatic startup re-lighting cycle.

15. The method of claim 14, further comprising the step of:

(g) if said automatic startup re-lighting cycle is unsuccessful turning said system "off."

16. The method of claim 14, further comprising the step of:

(g) sensing said flame is extinguished when said system is "on";

(h) commencing an automatic re-lighting cycle to relight said flame; and, (i) if said automatic re-lighting cycle is unsuccessful turning said system "off".

* * * * *